United States Patent [19]

Kreusler

[11] 4,084,629

[45] Apr. 18, 1978

[54] ROUTER CLAMP

[76] Inventor: George E. Kreusler, 22441 Alpine Way, Palm Springs, Calif. 92262

[21] Appl. No.: 735,608

[22] Filed: Oct. 26, 1976

[51] Int. Cl.[2] ..... B27C 5/10

[52] U.S. Cl. ..... 144/134 D; 24/263 A; 144/1 F; 144/35 A; 269/287

[58] Field of Search ..... 90/12 D; 144/134 D, 144/136 C, 1 R, 1 E, 1 F, 35 R, 35 A, 134 A; 24/263 A, 263 DB; 269/287

[56] References Cited

U.S. PATENT DOCUMENTS

| | | | |
|---|---|---|---|
| 2,702,569 | 2/1955 | Yelle | 144/134 D X |
| 2,846,682 | 8/1958 | Kalbow | 269/287 X |
| 2,982,320 | 5/1961 | Trumbull et al. | 144/134 D X |
| 3,099,298 | 7/1963 | Bellini | 144/1 F |
| 3,179,136 | 4/1965 | De Santis | 144/35 R X |
| 3,288,183 | 11/1966 | Eisbrenner | 144/136 C |
| 3,738,214 | 6/1973 | Wilson | 144/1 R X |

FOREIGN PATENT DOCUMENTS

| | | | |
|---|---|---|---|
| 20,367 of | 1909 | United Kingdom | 24/263 A |

*Primary Examiner*—Donald R. Schran
*Assistant Examiner*—W. D. Bray
*Attorney, Agent, or Firm*—Fulwider, Patton, Rieber, Lee & Utecht

[57] ABSTRACT

A router clamp for positioning and attaching a router having a housing to a radial saw arm so as to enable a user to accomplish overhead routing operations. The router clamp includes a bridge plate member affixed to a pair of inverted L-shaped brackets, one of the brackets being adjustably and removably affixed to the bridge plate member, a substantially cylindrical collar comprising two half sections for securing the router therein with the aid of an adjustable compression band to inwardly compress the half cylindrical sections of the collar against the router housing.

4 Claims, 1 Drawing Figure

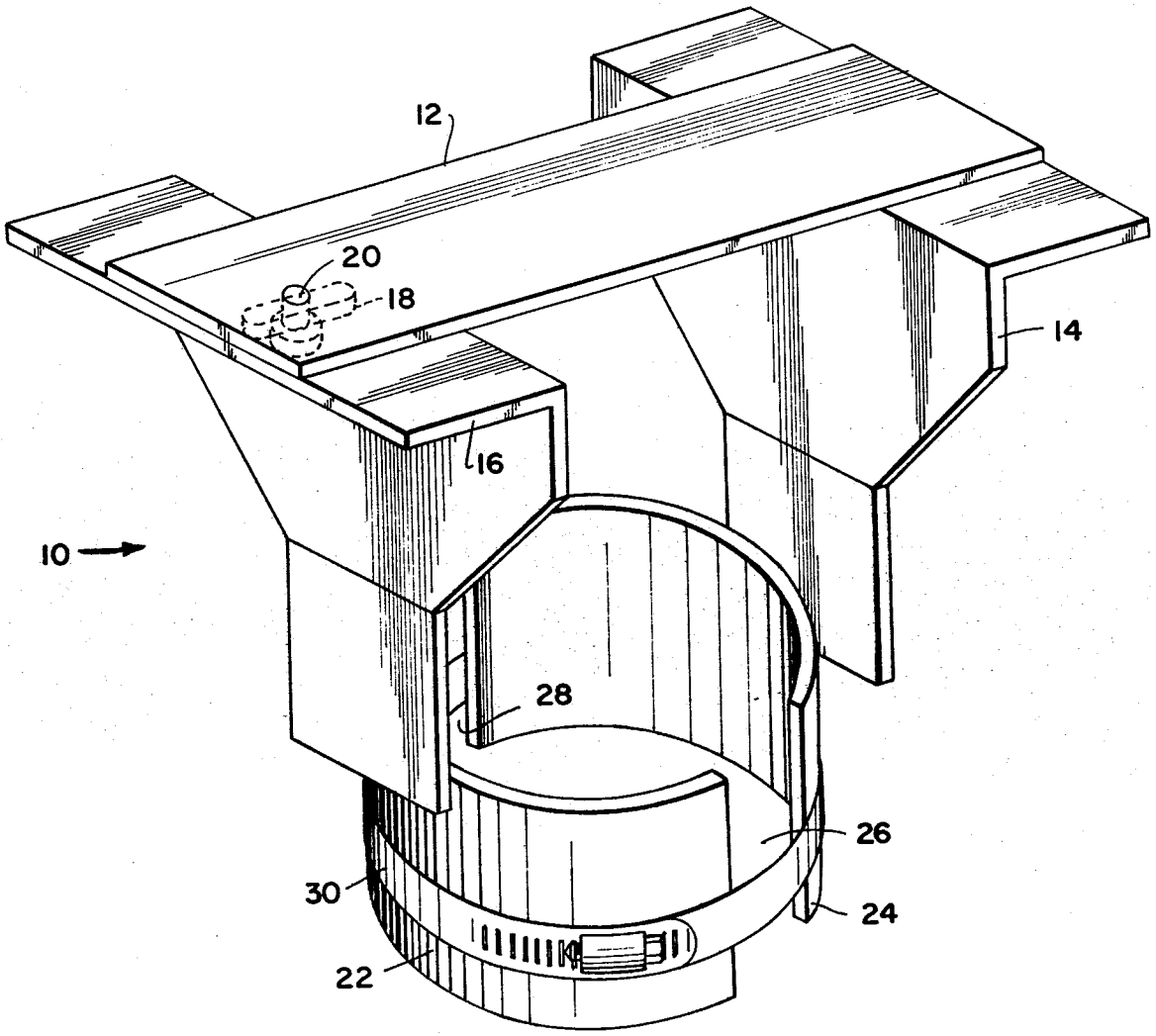
14
12
16
18
20
28
26
24
22
30
10

ROUTER CLAMP

BACKGROUND OF THE INVENTION

A conventional radial saw includes a horizontal support arm which is adjustable for up and down movement such as by means of an associated crank mounted on the radial saw arm. In accordance with the present invention, I have discovered that such a radial saw can be modified with the aid of my router clamp to fasten a standard size router to the arm of the radial saw. Thus, the router clamp in combination with a standard router having a housing enables a user of the radial saw to perform various routing functions in an economical manner. Further, the present invention router clamp is adaptable to various router housing circumferences in a quick and easy manner without having to adjust numerous bolts and/or screws.

SUMMARY OF THE INVENTION

The present invention provides a router clamp for positioning and attaching a standard router having a housing to a radial saw arm. More particularly, the router clamp comprises a bridge plate member affixed to a pair of inverted L-shaped brackets, one of the brackets being adjustably and removably affixed to the lower surface and at one end of the bridge plate member. The adjustably affixed bracket is secured to the bridge plate member by means of a slot provided in the top position of the bracket which cooperates with a threaded bolt and nut depending from the bridge plate member. The router clamp further includes a substantially cylindrical collar composed of two half sections affixed to the lower portion of the inverted L-shaped brackets which half sections define two longitudinal collar openings. These longitudinal openings allow the collar to be compressible inwardly so as to contact and hold the router in place. Further, the clamp includes a compression band which assists concentric gripping action of the collar when the band is tightened over the periphery of the collar extending bridge-wise over the longitudinal openings.

Accordingly, a radial saw which includes a support arm can be converted to an overhead router by the use of a router having a housing and the router clamp which holds the router. The router with router clamp may then be fastened to the support arm of the radial saw by means of a conventional C-clamp. Moreover, the router clamp is adaptable to various router housing circumferences in a quick and easy manner by the adjustability of one of the inverted L-shaped brackets carrying the half cylindrical section.

BRIEF DESCRIPTION OF THE DRAWING

FIG. 1 illustrates a perspective of a router clamp in accordance with the present invention.

DETAILED DESCRIPTION

The present invention relates to a router clamp which enables a standard router having a housing such as a Black and Decker type, to be secured to a support arm of a conventional radial saw. Accordingly, when the router is secured to the support arm, adjustment means provided on the support arm of the radial saw can be used to position the secured router to perform overhead routing functions.

The present router clamp 10 comprises a bridge plate member 12 affixed to a pair of inverted L-shaped brackets 14 and 16, one of the brackets 16 being adjustably and removably affixed to the bridge plate member 12 by means of a slot 18, bolt 20 and nut. The clamp further includes a substantially cylindrical collar comprising two half sections 22 and 24 which, when suitably assembled, define a cylinder having two longitudinal openings 26 and 28 that permit the collar to be compressible inwardly so as to contact and hold the router in place with the aid of a compression band 30 to assist concentric gripping action of the collar. The compression band 30 is positioned on the periphery of the collar and preferably extends bridge-wise over the longitudinal openings 26 and 28.

More particularly, one inverted L-shaped bracket 16 is adjustably and removably affixed to the lower surface and at one end of the bridge plate member 12 by means of a slot 18, bolt 20 and nut. The slot is provided in the top portion of the adjustably affixed bracket 16 and receives a threaded bolt 20 depending from the bridge plate member 12. The bolt is sized to receive the internal threads of a nut which secures the bracket to the bridge plate member.

Accordingly, the bolt is inserted through a drill hole provided at one end of the bridge plate member 12 and through the slot 18 provided at the top portion of the inverted L-shaped bracket 16. The circumference of the collar is selected by moving the adjustable bracket 16 to the desired width and then tightening the nut to secure the bracket 16 to the lower surface of the bridge plate member 12. Thus, the only moving part which is required to open and close the router clamp is the nut and bolt. A conventional C-clamp may be used to fasten the router and router clamp to the support arm of the radial saw.

Preferably, the router clamp is formed of 3/16 inch steel stock which is bent and welded to form the router clamp shown in FIGS. 1 through 4. Typically, a 5/16 inch machine screw is sufficient to secure the adjustable inverted L-shaped bracket to the bridge plate member. Each half section of the substantially cylindrical collar are sized for example, having a $1\frac{3}{4}$ inch radius and when bolt half sections are positioned by the brackets they define a $3\frac{1}{2}$ inch diameter cylinder which can be adjusted to a $4\frac{1}{2}$ inch diameter cylinder for holding the standard sized router in place. A base which is usually provided on a standard router is removed prior to being inserted into the collar portion of the clamp.

The half sections of the collar may be affixed to the inverted L-shaped brackets such as by welding. The bridge plate member will preferably be formed of a two inch wide section of steel which is welded to the permanently secured bracket. The removable inverted L-shaped bracket preferably is provided with a 5/16 inch wide slot running one inch in length longitudinally in close proximity to one end of the bridge plate member.

A standard adjustable compression band preferably formed of steel may be used to secure the router in place by compressing the half sections of the cylindrical collar inwardly so as to contact the router housing and to maintain the router in a fixed position.

Although this invention has been described in its preferred form with a certain degree of particularity, it is understood that the present disclosure of the preferred form has been made only by way of example and that numerous changes in the details of construction and the combination and arrangement of parts may be resorted to without parting from the spirit and scope of the invention as hereinafter claimed.

I claim:

1. A router clamp for attachment to a router having a housing, the router clamp including in combination a bridge plate member, a pair of inverted L-shaped brackets each bracket having an upper and lower portion, a substantially cylindrical collar and a compression band said bridge plate member being affixed to each upper portion of the pair of brackets, one of said brackets being adjustably and removably affixed to said bridge plate member by means of a slot, bolt and nut; the slot being disposed in the upper portion of said removably affixed bracket;

said substantially cylindrical collar comprising two half sections, each half section being affixed to the lower portion of each of the pair of brackets, so as to define two longitudinal collar openings which allow the half sections to be compressible inwardly so as to contact and hold the housing of the router when the router is positioned therein and when the compression band is tightened over the longitudinal openings on the periphery of the collar to assist concentric gripping action of the half sections.

2. The router clamp of claim 1 wherein said substantially cylindrical collar has a diameter range of from about 3½ inches to about 4½ inches.

3. The router clamp of claim 1 wherein said bridge plate member, said brackets and said collar are formed from steel.

4. A router clamp for attachment to a router having a housing, the router clamp including in combination a bridge plate member, a pair of brackets, each bracket having an upper and lower portion, a substantially cylindrical collar and a compression band said bridge plate member being affixed to each upper portion of the pair of brackets, one of said brackets being adjustably and removably affixed to said bridge plate member by means of a slot, bolt and nut; the slot provided in the upper portion of said removably affixed bracket;

said substantially cylindrical collar comprising two half sections, each half section being affixed to the lower portion of one of the pair of brackets, so as to define two longitudinal collar openings which allow the half sections to be compressible inwardly so as to contact and hold the housing of the router when the router is positioned therein and when the compression band is tightened over the longitudinal openings on the periphery of the collar to assist concentric gripping action of the half sections.

* * * * *

UNITED STATES PATENT AND TRADEMARK OFFICE

CERTIFICATE OF CORRECTION

PATENT NO. : 4,084,629

DATED : April 18, 1978

INVENTOR(S) : George E. Kreusler

It is certified that error appears in the above-identified patent and that said Letters Patent are hereby corrected as shown below:

Col. 1, Line 15, delete "invention"

Col. 1, Line 30, delete "position' and insert therefor
-- portion --

Col. 2, Line 42, delete "bolt" and insert therefor
-- both --

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*